United States Patent [19]

Ranini

[11] 3,977,148

[45] Aug. 31, 1976

[54] JIB HAVING TWO ADJUSTABLE ELEMENTS

[75] Inventor: Daniel G. Ranini, Verreddes, France

[73] Assignee: Societe Anonyme: Poclain, Le Plessis-Belleville, France

[22] Filed: Jan. 10, 1975

[21] Appl. No.: 540,090

[30] Foreign Application Priority Data

Jan. 21, 1974 France ..... 74.01946

[52] U.S. Cl. ..... 52/721; 52/116; 52/758 N; 212/144; 214/141; 403/85

[51] Int. Cl.[2] ..... E04H 12/34; E04B 1/343

[58] Field of Search ..... 52/115–118, 52/120, 721, 645, 726, 758 N; 212/144; 182/2; 214/141; 403/85, 83, 187

[56] References Cited

UNITED STATES PATENTS

| | | | |
|---|---|---|---|
| 2,429,009 | 10/1947 | Woolslayer et al. | 52/120 |
| 3,295,270 | 1/1967 | Woolslayer et al. | 52/117 |
| 3,465,904 | 9/1969 | Pensa | 214/141 X |
| 3,691,866 | 9/1972 | Berkes | 403/85 |

FOREIGN PATENTS OR APPLICATIONS

| | | | |
|---|---|---|---|
| 1,484,693 | 5/1969 | Germany | 214/141 |
| 2,014,669 | 10/1970 | Germany | 214/141 |

*Primary Examiner*—Ernest R. Purser
*Assistant Examiner*—Leslie Braun
*Attorney, Agent, or Firm*—Lewis H. Eslinger

[57] ABSTRACT

This invention relates to a jib of a public works machine constituted by two elements, a piece for connecting said two elements, and removable means for locking the piece to the elements.

The connecting piece is mounted on one element and comprises first holes disposed at the apex of a polygon; the other element comprises second holes separated from one another by distances equal to the length of the sides of the polygon; finally, when the jib is assembled, the connecting piece is fast with the first element via its axis of rotation and a removable pin introduced into a corresponding hole and in a special hole of said first element and fast with the second element via two removable pins introduced into corresponding holes.

One application of this invention is the realization of a hydraulic shovel whose overall size is reduced for suitable road-transport.

4 Claims, 5 Drawing Figures

JIB HAVING TWO ADJUSTABLE ELEMENTS

The present invention relates to a jib having two elements whose relative position is adjustable.

In the technical domain relative to the design and use of earth-working machines, such as in particular hydraulic shovels, it is known to be often advantageous to make the jib, which connects the working attachment to the frame of the machine, in two separate elements and to provide for the adjustment of the relative position of these two elements. One of the purposes is to reduce the overall length of the jib and thus enable the machine to be moved on the highway by giving it a gauge not exceeding the regulation limits.

For the envisaged arrangement to be completely efficient, the said adjustment must be easy to effect.

It is an object of the invention to propose this type of device for adjustment, which is noted for its simplicity both in constitution and execution, and for the safety of manoeuvring of adjustment resulting from its being adopted.

The invention is therefore relative to a jib of a public works machine constituted by:

- a first rigid element, and
- a second rigid element,
- a piece for connecting these two elements, which is mounted to rotate about an axis on the first element, and
- removable means for locking said connecting piece with respect to these two elements.

According to a particular feature of the present invention, the connecting piece comprises a plurality of first holes disposed at the top of a polygon. The second element itself comprises a plurality of second holes, which are separated from one another by distances equal to the length of the sides of said polygon taken in the order of continuous succession, on the one hand, of said second holes and, on the other hand, of the polygonal contour. Finally, when the jib is assembled, the connecting piece is fast, on the one hand with the first element, by its axis of rotation and a removable locking pin introduced into one of the first holes and in a special hole provided in the first element, and is fast on the other hand, with the second element by means of two removable locking pins each introduced into one of the first and into one of the second holes.

According to a further feature of the invention, the second holes are preferably substantially in alignment.

According to a further feature of the invention, it is often considered an advantage if the polygon is constituted by a equilateral triangle.

According to yet another feature of the invention, the connecting piece comprises two side plates which are each provided with a plurality of second holes and which are connected by a central beam through which the axis of rotation passes, whilst, when the jib is assembled, the second element is in abutment on said central beam.

Figure 1:
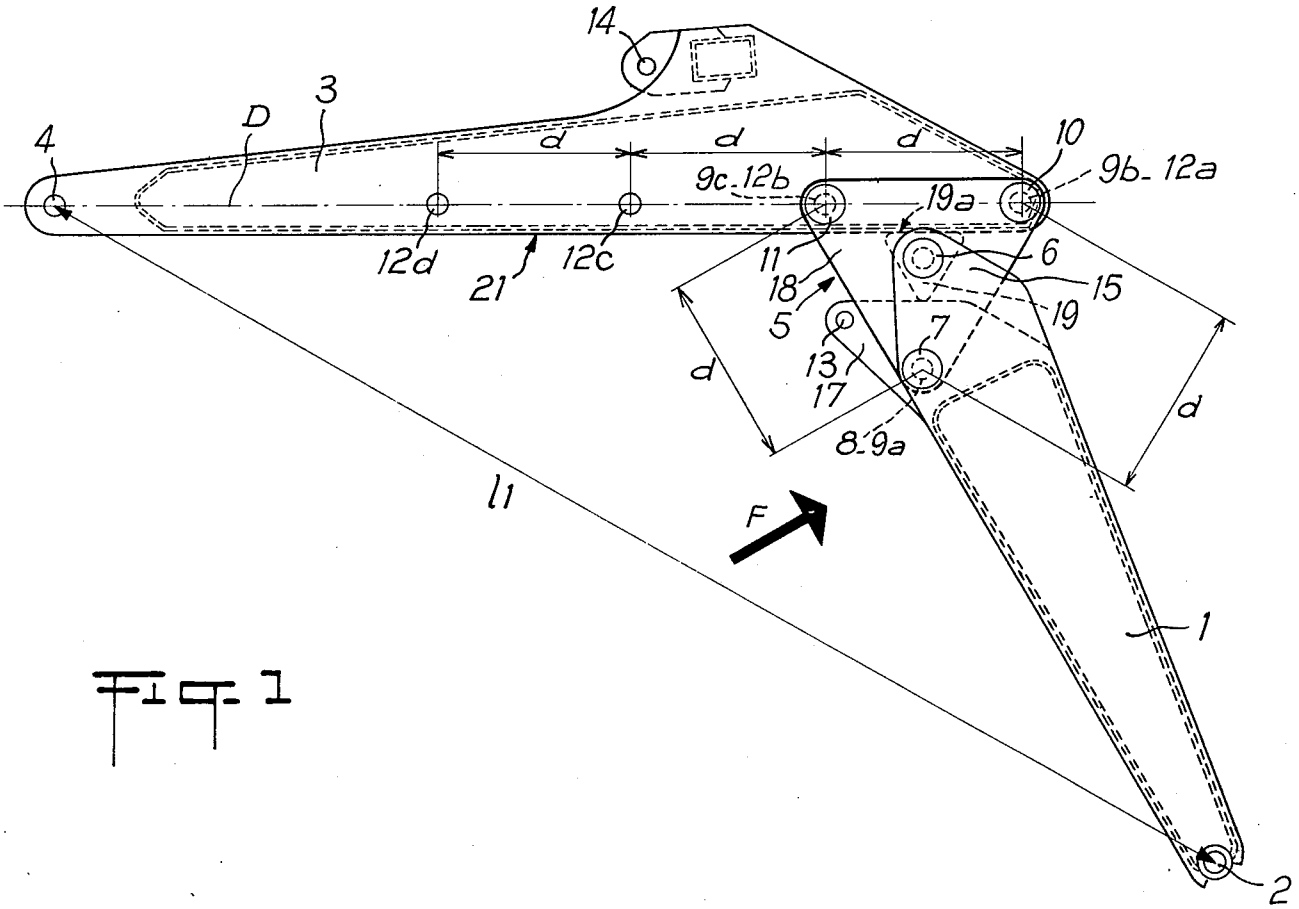
Figure 3:
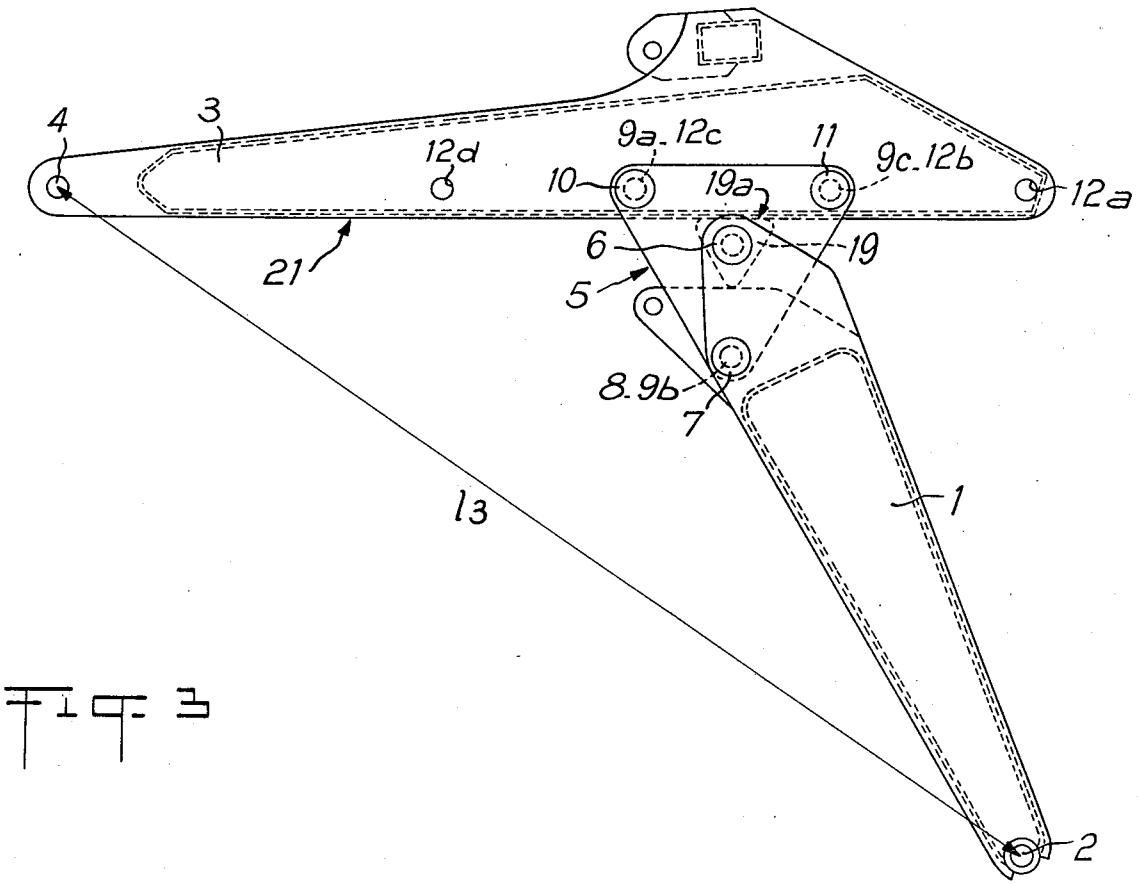
Figure 4:
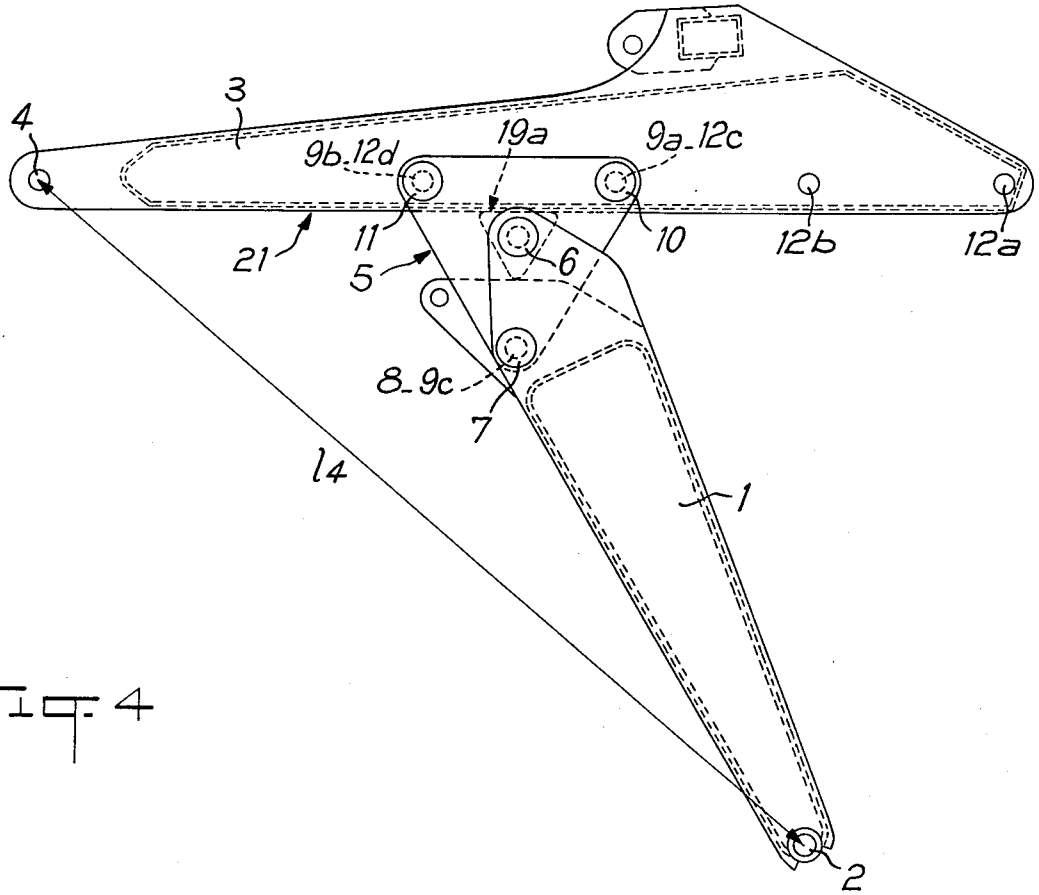
Figure 5:
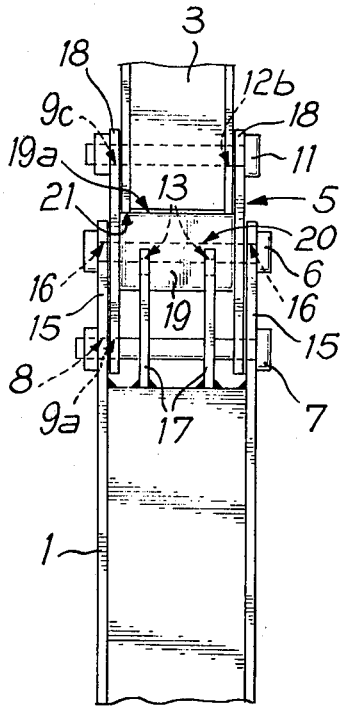

The invention will be more readily understood on reading the following description with reference to the accompanying drawings, in which :

FIGS. 1 to 4 show a composite jib according to the invention in four different configurations; and FIG. 5 is a view in the direction of arrow F of FIG. 1.

Referring now to the drawings, the jib shown in FIG. 1 is constituted by :

- a first element 1 which is articulated on the frame of the machine supporting it, about a pin introduced in a hole 2,
- a second element 3 on which the working attachment of the machine, generally constituted by a bucket, articulates about a pin introduced into a hole 4, and
- a connecting piece 5 which connects the rigid elements 1 and 3, by being fast on the one hand with the first element 1 by means of an axis of rotation 6 and a locking pin 7, which is removably introduced into a special hole 8 provided in the element 1 and in one 9*a* of the three first holes 9*a*, 9*b* and 9*c*, made in the piece 5, and fast on the other hand with the second element 3 by means of two locking pins 10 and 11 which are each removably introduced in one of the first holes 9*b*, 9*c* mentioned hereinabove and in one of the holes 12*a*, 12*b*, 12*c*, 12*d* of a second series of holes made in the second element 3. The pin 10 is thus introduced into holes 9*b* and 12*a*, whilst pin 11 is introduced into holes 9*c* and 12*b*.

The following points may be noted :

- another hole 13 is made in the first element 1 to enable a jack manoeuvring the element 1-element 3 assembly and working attachment coupled to the element 3, to be coupled in known manner;
- similarly, another hole 14 is made in the second element 3, in known manner, to enable a jack manoeuvring the working attachment, to be coupled;
- the various second holes 12*a*, 12*b*, 12*c* and 12*d* are aligned along a straight line D;
- the first holes 9*a*, 9*b*, 9*c* are disposed at the top of a polygon, constituting, in the present case, a equilateral triangle of side length *d;*
- the two holes 12*a*, 12*b*, 12*c*, 12*d* are separated from one another by a distance exactly equal to the length *d* of the sides of the equilateral triangle mentioned above;
- finally, the axis of rotation 6 is disposed at the centre of the circle circumscribed on the equilateral triangle and therefore at equal distance from the three holes 9*a*, 9*b*, 9*c*.

To allow the connecting piece 5 to be assembled on the first element 1, said piece 5 and the corresponding end of said element 1 are shaped as defined hereinafter.

The end of the element 1 comprises, on the one hand, two lugs 15 between which the piece 5 is disposed and which are provided with holes 16 for the passage of the pin 6, and, on the other hand, a central appendix 17 provided with the hole 13.

As far as the connecting piece 5 is concerned, it is constituted by two side plates 18 which are provided with holes 9*a*, 9*b* and 9*c* and which are connected by a central beam 19 which is provided with a hole 20 through which the pin 6 passes.

It is to be noted that the beam 19 has the section of an equilateral triangular whose sides 19*a* are parallel to the sides of the main triangle (holes 9*a*, 9*b* and 9*c*). Furthermore the lower face 21 of the second element 3 abuts on one of the sides 9*a* of said beam.

Figure 2:
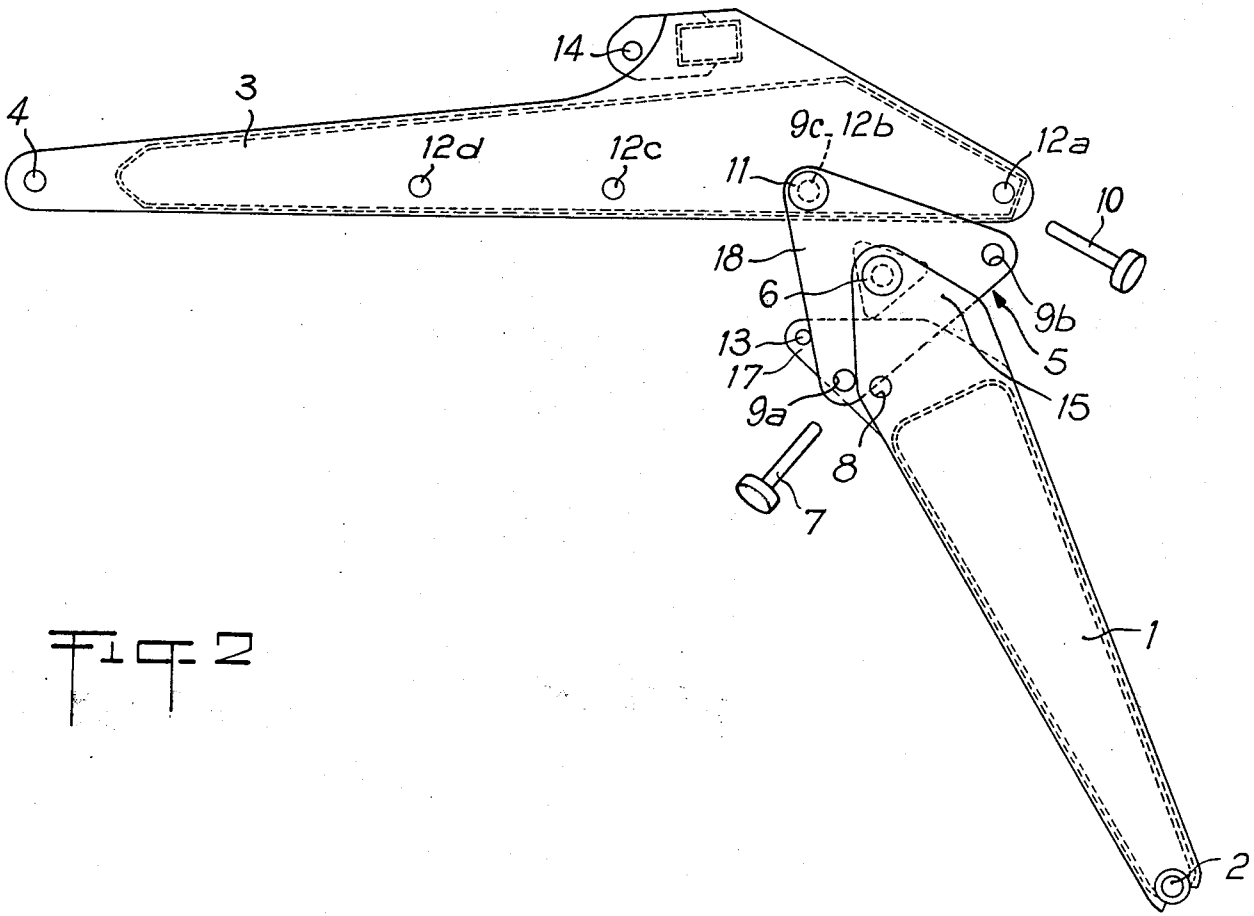

FIG. 2 shows the assembly which has just been described, but in a new configuration. The pin 7 has been removed from holes 8 and 9*a* and pin 10 has been taken out of holes 9*b* and 12*a*. Consequently, the connecting piece 5 is now coupled to the first element 1 only by the pin 6 and to the second element 3 by the pin 11 acting both as axis of rotation as well as attachment of the piece 5 to the element 3. This disposition has made it possible to pivot the connecting piece 5 slightly with respect to each of the two elements 1 and 3 in the direction whereby its hole 9*a* is brought towards hole 12*c* of said second element 3.

With regard to FIG. 3, it is noted that, the connecting piece 5 having continued to rotate, the hole 9*a* is opposite hole 12*c*, whilst the hole 9*b* is opposite hole 8. The pin 10 has therefore been introduced into holes 9*a* and 12*c* and the connecting piece 5 is again fast with the second element 3 (in cooperation with pin 11). Similarly, the pin 7 has been introduced into the apertures 9*b* and 8 and the connecting piece 5 is again fast with the first element 1. In this new configuration, the elements 1 and 3 are therefore securely connected together again.

The same operation may be carried out a second time, this time to bring the holes 9*b* and 12*d* into register. This results in the configuration as shown in FIG. 4, in which the pin 10 remained in holes 9*a* and 12*c* during the modification from FIG. 3 to FIG. 4.

The distances between axes 2 and 4 are l1, l3 and l4 respectively for the configurations of FIGS. 1, 3 and 4, l1 being longer than l3, which is itself longer than l4, with the result that the overall bulk of the complete jib is more and more reduced, at least in length, when the configuration thereof changes from FIG. 1 to FIG. 4.

The advantages to be had from adopting the jib which has been described will now be set forth.

Firstly, it is noted on the one hand that the dispositions described enable the length l1, l3, and l4 of the jib to be adjusted and on the other hand that this adjustment is a simple matter.

In addition, this adjustment is effected in excellent conditions of safety since the connecting piece 5 is always attached to each of elements 1 and 3, that is to say, permanently, to element 1, by the pin 6, and to element 3 by at least one of pins 10 and 11.

The fact that an equilateral triangle has been chosen for constituting the connecting piece 5 enables realization thereof to be simple, efficient and relatively inexpensive. In particular, the distances between two successive holes 9*a*, 9*b*, 9*c* being equal, the distances between successive holes 12*a*, 12*b*, 12*c* and 12*d* are also equal. This disposition simplifies machining both of the piece 5 and of element 3, but also simplifies assembly, since there is no preferred direction for coupling the piece 5 to element 3. However, as a variant, it would also be possible to adopt a polygon other than a triangle and such a polygon could even be irregular (having sides of unequal length), as long as the distances between the holes 12*a*, 12*b*, 12*c* and 12*d* of element 3 correspond to the distances separating the corresponding holes 9*a*, 9*b*, 9*c* of the connecting piece 5.

In the embodiment shown, a further advantage resides in the support of the lower face 21 of the second element 2 on one of the sides 19*a* of the beam 19, in the assembled configurations of the jib (FIGS. 1, 3 and 4). This arrangement is advantageous, since the support of the lower face 21 on one of the sides 19*a* enables an accurate and simple alignment of the holes made in the element 3 and in side plates 18, Consequently facilitating the introduction of the corresponding pin 10 or 11 in said holes.

Finally, it is often preferred to arrange the holes 12*a*, 12*b*, 12*c* and 12*d* in a straight line D, since the angle of elements 1 and 3 is then constant. However, this disposition is not the only one that may be adopted.

One advantageous application of the jib described is the realization of a hydraulic shovel whose overall bulk is adjustable so that its gauge can be sufficiently reduced to become, at the most, equal to the maximum gauge allowed by highway regulations. A dismantling of the whole jib, which could involve difficulties in handling the heaviest pieces, is therefore avoided.

What is claimed is:

1. A jib for a public works machine comprising, a first rigid element, a second rigid element, a connecting piece for connecting said first and second rigid elements, said connecting piece being rotatably mounted to rotate about a first axis on said first element, and a plurality of removable means for locking said connecting piece in a relatively fixed position to said first and second rigid elements, said connecting piece having a polygonal configuration and including a plurality of first holes formed therein disposed respectively adjacent the corners of the polygonal connecting piece, said second element having a plurality of second holes formed therein in a predetermined pattern separated from one another by distances equal to the distances between the first holes in said connecting piece taken in the order of continuous succession, said first rigid element having an opening formed therein located to align with one of the holes in said connecting piece and receiving one of said removable locking means whereby said connecting piece is secured to the first element and releasably held against rotation with respect thereto, and at least two of the first holes in said connecting piece being aligned with two of the second holes in said second rigid element and receiving two of said removable locking means respectively whereby said connecting piece is also secured to the second element and releasably held against rotation with respect thereto, to form a releasable rigid coupling between said first and second rigid elements

2. A jib as claimed in claim 1, wherein said second holes are located substantially in alignment along as straight line on said second rigid element.

3. A jib as claimed in claim 2, wherein the polygonal connecting piece comprises an equilateral triangle.

4. A jib as claimed in claim 3, wherein the connecting piece comprises two side plates each of which has said plurality of second holes formed therein respectively in alignment with each other and a central beam connecting said plates and having an opening therethrough which defines said first axis of rotation and against which, when the jib is assembled, the second element is in abutment.

* * * * *